US009748650B2

(12) United States Patent
Chi et al.

(10) Patent No.: US 9,748,650 B2
(45) Date of Patent: Aug. 29, 2017

(54) ANTENNA STRUCTURE AND WIRELESS COMMUNICATION DEVICE USING SAME

(71) Applicant: FIH (HONG KONG) LIMITED, Kowloon (HK)

(72) Inventors: Chuan-Chou Chi, New Taipei (TW); Chi-Sheng Liu, New Taipei (TW); Cheng-Hung Ko, New Taipei (TW); Hao-Ying Chang, New Taipei (TW)

(73) Assignee: FIH (HONG KONG) LIMITED, Kowloon (HK)

( * ) Notice: Subject to any disclaimer, the term of this patent is extended or adjusted under 35 U.S.C. 154(b) by 128 days.

(21) Appl. No.: 14/685,027

(22) Filed: Apr. 13, 2015

(65) Prior Publication Data

US 2016/0190689 A1 Jun. 30, 2016

(30) Foreign Application Priority Data

Dec. 31, 2014 (TW) ..... 103146459 A

(51) Int. Cl.

| | |
|---|---|
| ***H01Q 5/00*** | (2015.01) |
| ***H01Q 5/371*** | (2015.01) |
| ***H01Q 1/24*** | (2006.01) |
| ***H01Q 9/04*** | (2006.01) |

(52) U.S. Cl.
CPC ..... *H01Q 5/371* (2015.01); *H01Q 1/243* (2013.01); *H01Q 9/0421* (2013.01)

(58) Field of Classification Search
USPC ..... 343/700 MS, 702, 843
See application file for complete search history.

(56) References Cited

U.S. PATENT DOCUMENTS

2012/0249393 A1* 10/2012 Hotta ..... H01Q 1/243 343/843

* cited by examiner

*Primary Examiner* — Hoang Nguyen
*Assistant Examiner* — Hai Tran
(74) *Attorney, Agent, or Firm* — Steven Reiss

(57) ABSTRACT

An antenna structure includes a feed unit, a grounding unit, a first radiating unit, a second radiating unit, third radiating unit, fourth radiating unit, and a fifth radiating unit. The grounding unit is spaced apart from the feed unit. The first radiating unit is electrically connected to the feed unit. The second radiating unit is electrically connected to the grounding unit. The third radiating unit is electrically connected to the first radiating unit, the second radiating unit, and the fourth radiating unit. The fifth radiating unit is electrically connected to the feed unit and couples with the fourth radiating unit.

20 Claims, 6 Drawing Sheets

ANTENNA STRUCTURE AND WIRELESS COMMUNICATION DEVICE USING SAME

FIELD

The subject matter herein generally relates to an antenna structure and a wireless communication device using the antenna structure.

BACKGROUND

A wireless communication device uses antennas to transmit and receive wireless signals at different frequencies for different communication systems. The structure of the antenna assembly is complicated and occupies a large space in the wireless communication device, which is inconvenient for a minimization of the wireless communication device. In addition, some other metal electronic elements, such as a universal serial bus (USB), a battery, electromagnetic shielding, and a display, may affect the transmission of the antenna.

BRIEF DESCRIPTION OF THE DRAWINGS

Implementations of the present technology will now be described, by way of example only, with reference to the attached figures.

DETAILED DESCRIPTION

Figure 1:
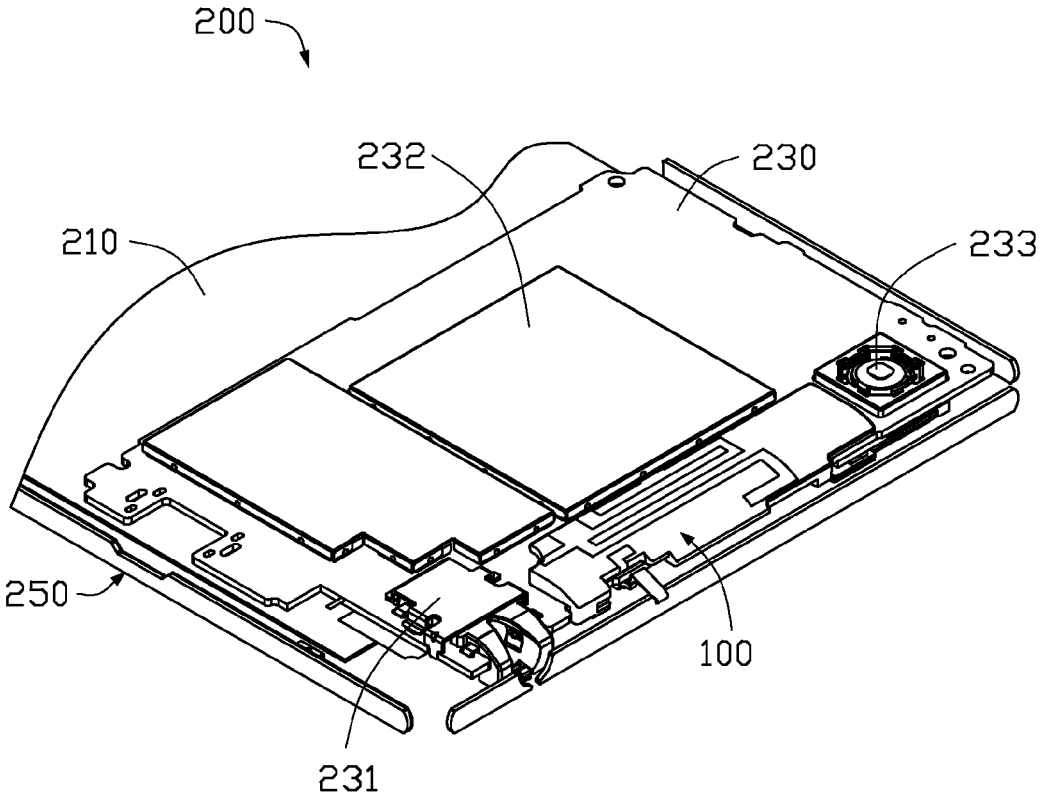
FIG. 1 is an assembled, isometric view of an embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates an embodiment of a wireless communication device 200. The wireless communication device 200 can be a mobile phone or a personal digital assistant, for example. The wireless communication device 200 includes a grounding plane 210, a baseboard 230, a metallic portion 250, and an antenna structure 100.

In this embodiment, the grounding plane 210 can be a metallic frame of the wireless communication device 200 and the baseboard 230 can be a printed circuit board. The baseboard 230 is positioned at one side of the grounding plane 210 and is electrically connected to the grounding plane 210 for being grounded.

The wireless communication device 200 further includes a plurality of electronic elements. In this embodiment, the wireless communication device 200 includes at least a first element 231, a second element 232, and a third element 233. The first element 231, the second element 232, and the third element 233 are positioned on a first surface of the baseboard 230 and are all positioned surround the antenna structure 100.

Figure 2:
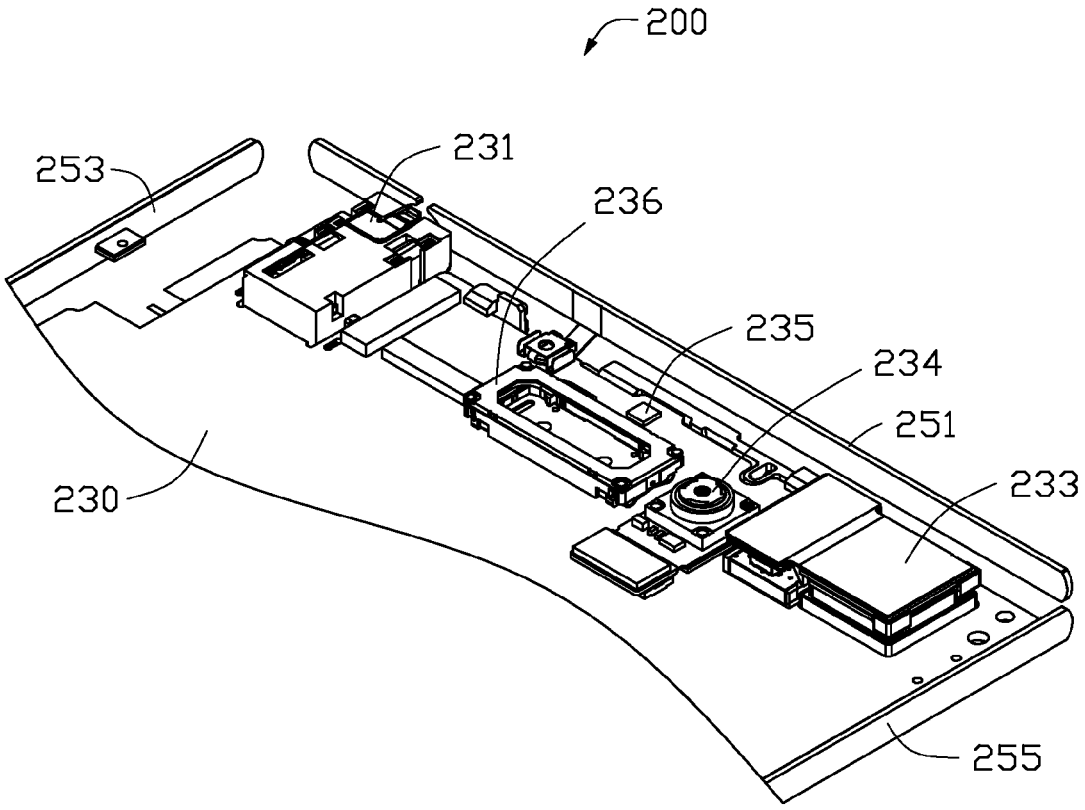
FIG. 2 is similar to FIG. 1, but shown in another angle.

Referring to FIG. 2, the wireless communication device 200 further includes a fourth element 234, a fifth element 235, and a sixth element 236. The fourth element 234, the fifth element 235, and the sixth element 236 are positioned at a second surface of the baseboard 230 opposite to the first surface of the baseboard 230. In this embodiment, the first to sixth elements 231-236 are all metallic elements. In detail, the first element 231 is an audio interface module. The second element 232 is a shielding can. The third element 233 is a back camera module. The fourth element 234 is a front camera module. The fifth element 235 is a light emitting diode. The sixth element 236 is an audio receiver.

The metallic portion 250 can be a portion of a housing of the wireless communication device 200. In this embodiment, the metallic portion 250 includes a first frame 251, a second frame 253, and a third frame 255. The first frame 251 is positioned parallel to one side of the baseboard 230. The second frame 253 and the third frame 255 are parallel to each other and are perpendicularly connected to two ends of the first frame 251. The first frame 251, the second frame 253, and the third frame 255 cooperatively form a U-shaped structure for surrounding the baseboard 230.

Figure 3:
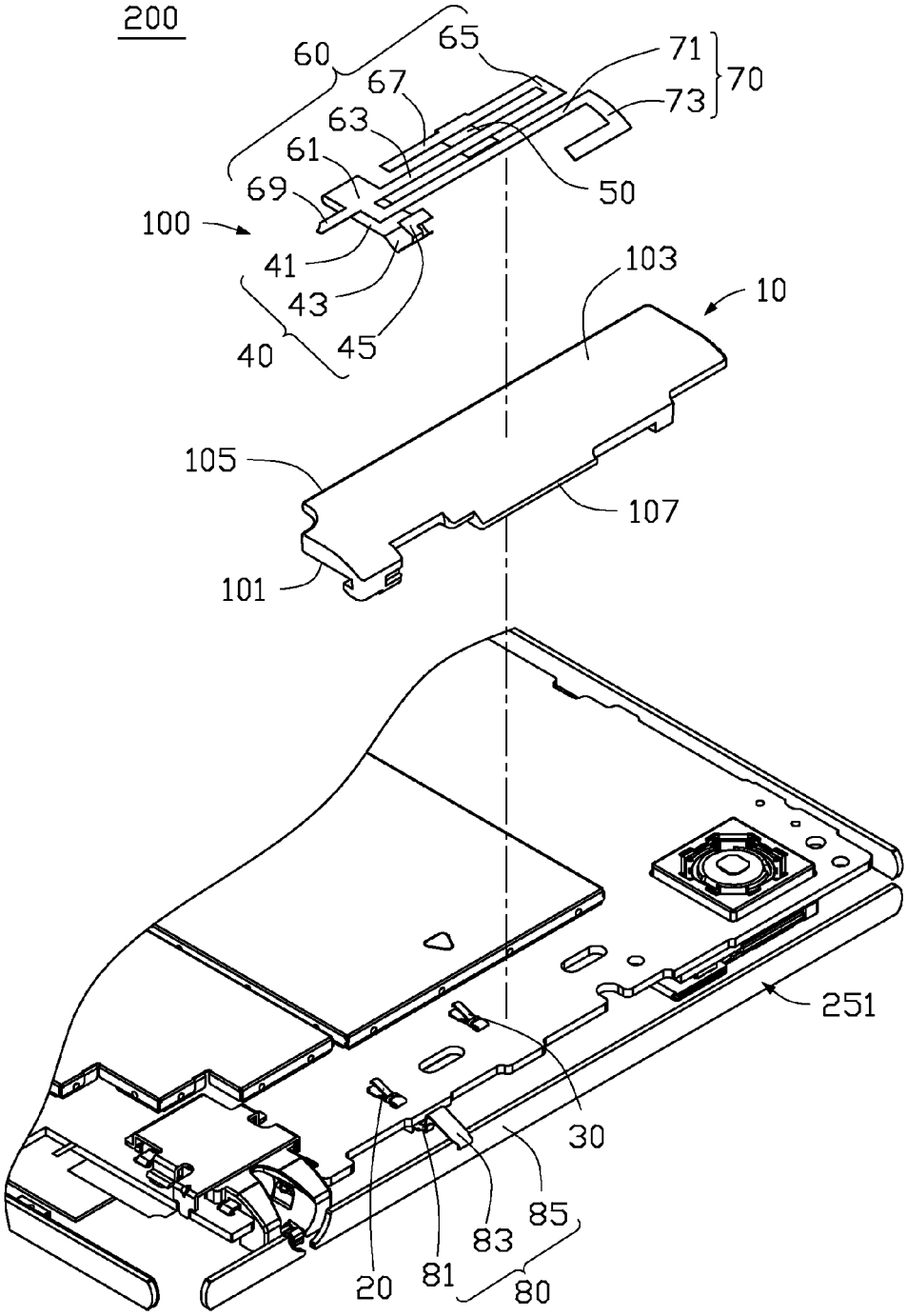
FIG. 3 is an exploded, isometric view of the wireless communication device of FIG. 1.

FIG. 3 illustrates that the antenna structure 100 includes an antenna holder 10, a feed unit 20, a grounding unit 30, a first radiating unit 40, a second radiating unit 50, a third radiating unit 60, a fourth radiating unit 70, and a fifth radiating unit 80.

The antenna holder 10 can be made of non-conductive material, such as plastic material. The antenna holder 10 is secured to one side of the baseboard 230 adjacent to the first frame 251 and is substantially parallel to the first frame 251. The antenna holder 10 includes a bottom surface 101, a top surface 103, a first side surface 105, and a second side surface 107. The bottom surface 101 is positioned facing the baseboard 230. The top surface 103 is positioned opposite to the bottom surface 101. The first side surface 105 and the second side surface 107 are parallel to each other and are substantially perpendicularly connected between the bottom surface 101 and the top surface 103.

The feed unit 20 and the grounding unit 30 are positioned on the first surface of the baseboard 230 and are spaced apart from each other. One end of the feed unit 20 is electrically connected to a radio frequency circuit (not shown) of the wireless communication device 200. The other end of the feed unit 20 is electrically connected to the first radiating unit 40 for feeding current to the antenna structure 100. One end of the grounding unit 30 is grounded by the baseboard 230 and the other end of the grounding unit 30 is electrically connected to the second radiating unit 50.

In this embodiment, the first radiating unit 40, the second radiating unit 50, the third radiating unit 60, and the fourth radiating unit 70 are located on surfaces of the antenna holder 10 via a means of laser direct structuring (LDS).

The first radiating unit 40 includes a first radiating sheet 41, a second radiating sheet 43, and a third radiating sheet 45. The first radiating sheet 41 is substantially L-shaped. One end of the first radiating sheet 41 is positioned on the first surface 101 of the antenna holder 10 and resists the feed unit 20 for being electronically connected to the feed unit 20. The other end of the first radiating sheet 41 is positioned on the first side surface 105 and is perpendicularly connected to the end of the first radiating sheet 41 positioned on the bottom surface 101. The second radiating sheet 43 is angled with one end of the first radiating sheet 41 adjacent to the second side surface 107. The third radiating sheet 45 is substantially L-shaped. The third radiating sheet 45 is positioned on the top surface 103 and is electronically connected to one end of the second radiating sheet 43 away from the first radiating sheet 41.

The second radiating unit 50 is substantially L-shaped sheet. One end of the second radiating unit 50 is positioned on the bottom surface 101 and resists the grounding unit 30 to be grounded. The other end of the second radiating unit 50 is positioned on the first side surface 105 and extends towards a junction between the top surface 103 and the first side surface 105.

The third radiating unit 60 is positioned on the top surface 103 and includes a first radiating section 61, a second radiating section 63, a third radiating section 65, a fourth radiating section 67, and an extending section 69. The first radiating section 61 is substantially rectangular. One end of the first radiating section 61 is coupled to one end of the first radiating sheet 41 positioned on the first side surface 105. The other end of the first radiating section 61 extends towards the second side surface 107. The second radiating section 63 is substantially rectangular strip. The second radiating section 63 is perpendicularly connected to one side of the first radiating section 61 and extends towards the grounding unit 30.

The third radiating section 65 is perpendicularly connected to one end of the second radiating section 63 away from the first radiating section 61 and extends towards the first side surface 105. The fourth radiating section 67 is substantially a strip. The fourth radiating section 67 is perpendicularly connected to one end of the third radiating section 65 away from the second radiating section 63 and extends towards the first radiating section 61. One side of the fourth radiating section 67 away from the second radiating section 63 is electronically connected to one end of the second radiating unit 50 positioned on the first side surface 105. The extending section 69 is substantially a strip. The extending section 69 is perpendicularly connected to one side of the first radiating section 61 away from the second radiating section 63 and extends away from the second radiating section 63.

The fourth radiating unit 70 is positioned on the top surface 103 of the antenna holder 10 and includes a first connecting section 71 and a second connecting section 73. The first extending section 71 is substantially an L-shaped sheet. The first extending section 71 is electrically connected to a junction among the first radiating section 61, the second radiating section 63, and the extending section 69, extends towards the second side surface 107 along a direction parallel to the third radiating section 65, and extends towards the third radiating section 65 along a direction parallel to the second radiating section 63.

The second connecting section 73 is substantially an L-shaped sheet. The second connecting section 73 is perpendicularly connected to one end of the first connecting section 71 away from the first radiating section 61, extends away from second radiating section 63 along a direction parallel to the third radiating section 65, and extends towards the third radiating sheet 45 along a direction parallel to the second radiating section 63.

The fifth radiating unit 80 includes a latching member 81, a connecting member 83, and a coupling member 85. The latching member 81 is positioned on one surface of the baseboard 230 away from the feed unit 20 and is electrically connected to the feed unit 20. In this embodiment, the connecting member 83 is a metallic sheet. One end of the connecting member 83 is latched with the latching member 81. The other end of the connecting member 83 resists the coupling member 85 so as to electrically connect the coupling member 85 to the latching member 81. In this embodiment, the coupling member 85 is one portion of the first frame 251.

Figure 4:
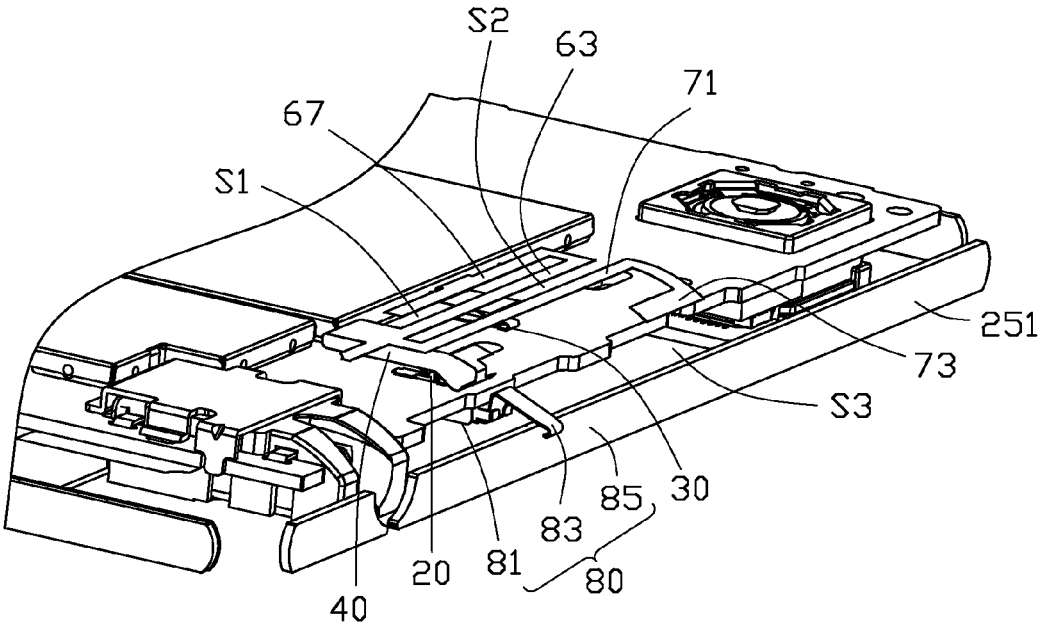
FIG. 4 is a partially enlarged view of the wireless communication device of FIG. 1.

FIG. 4 illustrates that a first slot S1 is defined between the second radiating section 63 and the fourth radiating section 67. A second slot S2 is defined between the second radiating section 63 and the first extending section 71. A third slot S3 is defined between the second connecting section 73 and the first frame portion 251.

When current is input from the feed unit 20, the current flows to the first frame 251 through the latching member 81 and the connecting member 83, thereby flowing to two ends of the first frame 251 for respectively activating a low-frequency mode (791 MHz-960 MHz) and a first high-frequency mode (2500 MHz-2690 MHz). In addition, the current from the feed unit 20 flows to the first radiating unit 40 and the third radiating unit 60, then is grounded through the second radiating unit 50 and the grounding unit 30, and further flows to the fourth radiating unit 70 for coupling with the coupling member 85 through the third slot S3, thereby activating a second high-frequency mode (1805 MHz-2170 MHz).

In other embodiments, by adjusting a contacting point between the connecting member 83 and the first frame 251 so as to adjust a length of the coupling member 85, or by adjusting widths of the first slot S1, the second slot S2, and the third slot S3, the resonance modes of the antenna structure 100 can be adjusted with a better impedance matching.

Figure 5:
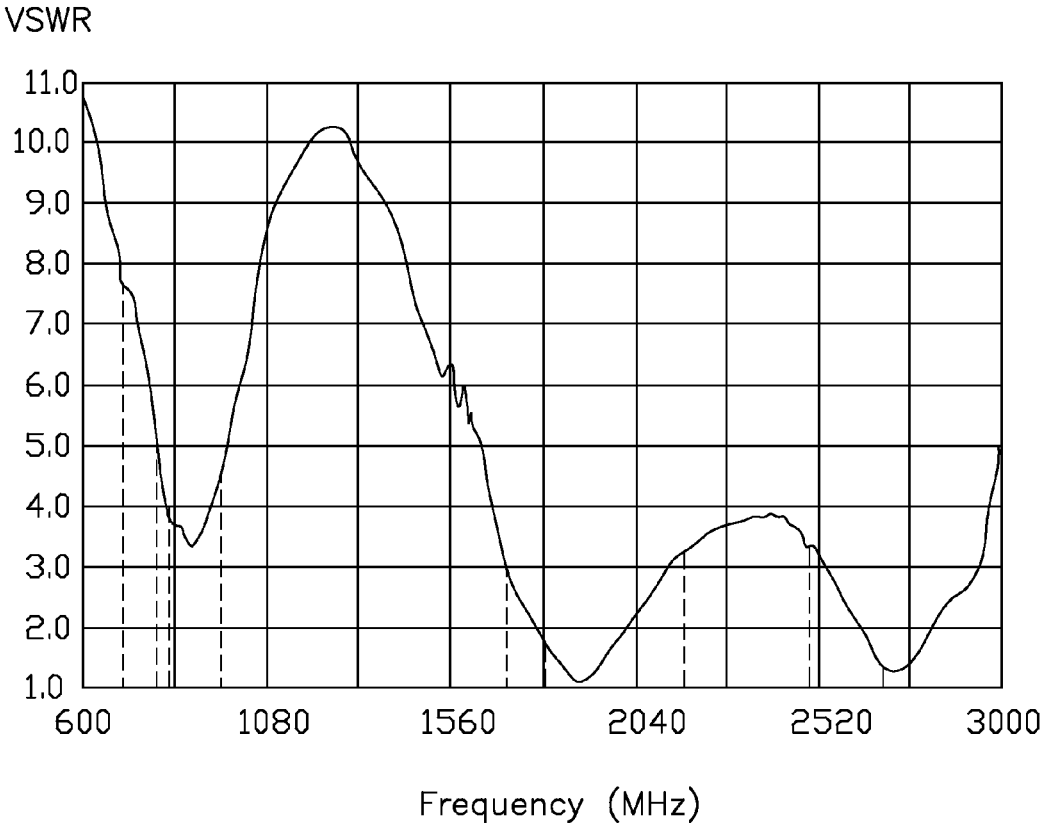
FIG. 5 is a voltage standing wave ratio (VSWR) graph of the antenna structure of the wireless communication device of FIG. 1.

FIG. 5 illustrates a voltage standing wave ratio (VSWR) measurement of the antenna structure 100. Table 1 shows a VSWR of the antenna structure 100 at frequencies of about 704 MHz, 791 MHz, 824 MHz, 960 MHz, 1710 MHz, 1805 MHz, 2170 MHz, 2500 MHz, and 2690 MHz. Clearly, it can be derived from FIG. 5 and table 1 that the antenna structure 100 and the wireless communication device 200 employing the antenna structure 100 can be utilized in common wireless communication systems and satisfy radiation requirements.

TABLE 1

| VSWR of the antenna structure at different frequencies | | | | | |
|---|---|---|---|---|---|
| | Frequency (MHz) | | | | |
| | 704 | 791 | 824 | 960 | 1710 |
| VSWR | 7.7226 | 5.3243 | 3.8683 | 4.5322 | 2.9384 |
| | Frequency (MHz) | | | | |
| | 1805 | 2170 | 2500 | 2690 | |
| VSWR | 1.7513 | 3.2346 | 3.3394 | 1.3751 | |

Figure 6:
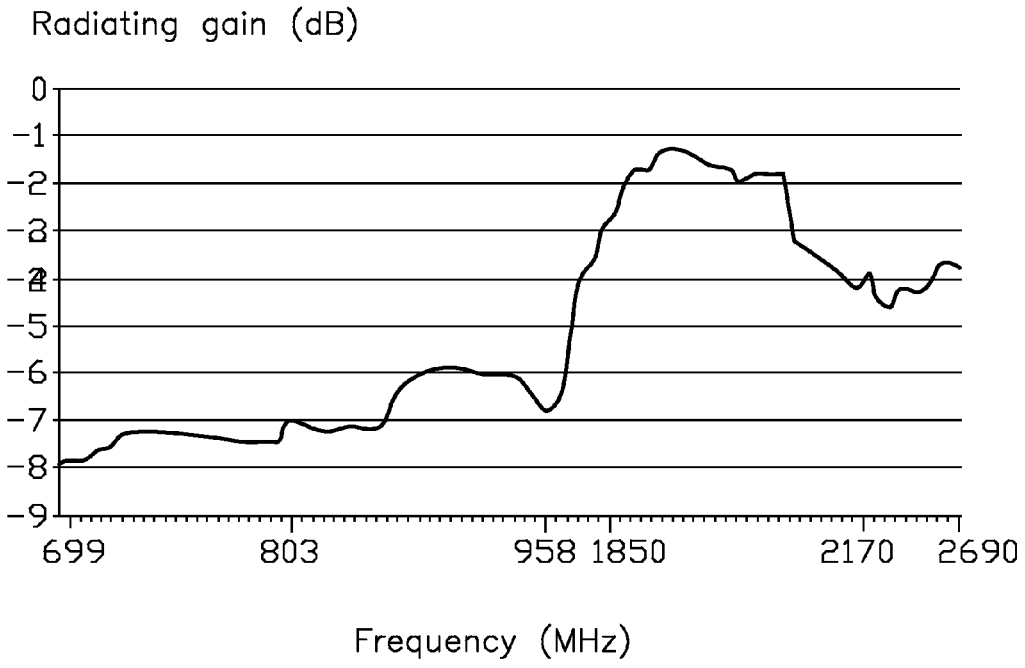
FIG. 6 is a radiating gain graph of the antenna structure of the wireless communication device of FIG. 1.

FIG. 6 illustrates a radiating gain measurement of the antenna structure 100. Clearly, it can be derived from FIG. 6 that a radiating gain of the antenna structure 100 keeps above −7.5 dB. Particularly, a radiating gain of the antenna structure 100 at the second high-frequency band (1805 MHz-2170 MHz) is above −2.7 dB, which makes the antenna structure 100 having a better radiating performance, with exceptional communication quality.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure comprising:

an antenna holder, the antenna holder comprising a bottom surface, a top surface, a first side surface, and a second side surface, wherein the top surface is positioned opposite to the bottom surface; the first side surface and the second side surface are parallel to each other and are perpendicularly connected between the bottom surface and the top surface;

a feed unit;

a grounding unit spaced apart from the feed unit;

a first radiating unit electrically connected to the feed unit and positioned on the bottom surface, the first side surface, and the top surface;

a second radiating unit electrically connected to the grounding unit;

a third radiating unit;

a fourth radiating unit; and a fifth radiating unit;

wherein the third radiating unit is electrically connected to the first radiating unit, the second radiating unit, and the fourth radiating unit, the fifth radiating unit is electrically connected to the feed unit and couples with the fourth radiating unit.

2. The antenna structure of claim 1, wherein the first radiating unit, the second radiating unit, the third radiating unit, and the fourth radiating unit are positioned on surfaces of the antenna holder via a laser direct structuring (LDS).

3. The antenna structure of claim 1, wherein the second radiating unit is positioned on the bottom surface and the first side surface; and the third radiating unit and the fourth radiating unit are both positioned on the top surface.

4. The antenna structure of claim 1, wherein the first radiating unit comprises a first radiating sheet, a second radiating sheet, and a third radiating sheet; one end of the first radiating sheet is positioned on the bottom surface and resists the feed unit, the other end of the first radiating sheet is positioned on the first side surface and is perpendicularly connected to the end of the first radiating sheet positioned on the bottom surface; the second radiating sheet is angled with one end of the first radiating sheet adjacent to the second side surface; the third radiating sheet is positioned on the top surface and is electronically connected to one end of the second radiating sheet positioned on the second side surface.

5. The antenna structure of claim 4, wherein the third radiating unit comprises a first radiating section, a second radiating section, a third radiating section, and a fourth radiating section, one end of the first radiating section is coupled to one end of the first radiating sheet positioned on the first side surface, the other end of the first radiating section extends toward the second side surface; the second radiating section is perpendicularly connected to one side of the first radiating section and extends toward the grounding unit; the third radiating section is perpendicularly connected to one end of the second radiating section away from the first radiating section and extends toward the first side surface; the fourth radiating section is perpendicularly connected to one end of the third radiating section away from the second radiating section and extends toward the first radiating section.

6. The antenna structure of claim 5, wherein the third radiating unit further comprises an extending section, the extending section is perpendicularly connected to one side of the first radiating section away from the grounding unit and extends away from the second radiating section.

7. The antenna structure of claim 6, wherein the fourth radiating unit comprises a first connecting section; the first connecting section is electrically connected to an junction among the first radiating section, the second radiating section, and the extending section, extends toward the second side surface along a direction parallel to the third radiating section, and extends toward the third radiating section along a direction parallel to the second radiating section.

8. The antenna structure of claim 7, wherein the fourth radiating unit further comprises a second connecting section; the second connecting section is perpendicularly connected to one end of the first connecting section away from the first radiating section, extends away from second radiating section along a direction parallel to the third radiating section, and extends toward the third radiating sheet along a direction parallel to the second radiating section.

9. The antenna structure of claim 1, wherein one end of the second radiating unit is positioned on the bottom surface and resists the grounding unit; and the other end of the second radiating unit is positioned on the first side surface and extends toward a junction between the top surface and the first side surface.

10. The antenna structure of claim 1, wherein the fifth radiating unit comprises a latching member, a connecting member, and a coupling member, the latching member is electrically connected to the feed unit; one end of the connecting member is electrically connected to the latching member, the other end of the connecting member is electrically connected to the coupling member.

11. A wireless communication device comprising:

a grounding plane;

a baseboard positioned on the grounding plane; and an antenna structure comprising:

an antenna holder, the antenna holder comprising a bottom surface, a top surface, a first side surface, and a second side surface, wherein the top surface is positioned opposite to the bottom surface; the first side surface and the second side surface are parallel to each other and are perpendicularly connected between the bottom surface and the top surface a feed unit positioned on the baseboard;

a grounding unit positioned on the baseboard and spaced apart from the feed unit;

a first radiating unit electrically connected to the feed unit and positioned on the bottom surface, the first side surface, and the top surface;

a second radiating unit electrically connected to the grounding unit;

a third radiating unit;

a fourth radiating unit; and a fifth radiating unit;

wherein the third radiating unit is electrically connected to the first radiating unit, the second radiating unit, and the fourth radiating unit, the fifth radiating unit is electrically connected to the feed unit and couples with the fourth radiating unit.

12. The wireless communication device of claim 11, wherein the first radiating unit, the second radiating unit, the third radiating unit, and the fourth radiating unit are positioned on surfaces of the antenna holder via a laser direct structuring (LDS).

13. The wireless communication device of claim 11, wherein the second radiating unit is positioned on the bottom surface and the first side surface; and the third radiating unit and the fourth radiating unit are both positioned on the top surface.

14. The wireless communication device of claim 11, wherein the first radiating unit comprises a first radiating sheet, a second radiating sheet, and a third radiating sheet; one end of the first radiating sheet is positioned on the bottom surface and resists the feed unit, the other end of the first radiating sheet is positioned on the first side surface and is perpendicularly connected to the end of the first radiating sheet positioned on the bottom surface; the second radiating sheet is angled with one end of the first radiating sheet adjacent to the second side surface; the third radiating sheet is positioned on the top surface and is electronically connected to one end of the second radiating sheet positioned on the second side surface.

15. The wireless communication device of claim 14, wherein the third radiating unit comprises a first radiating section, a second radiating section, a third radiating section, and a fourth radiating section, one end of the first radiating section is coupled to one end of the first radiating sheet positioned on the first side surface, the other end of the first radiating section extends toward the second side surface; the second radiating section is perpendicularly connected to one side of the first radiating section and extends toward the grounding unit; the third radiating section is perpendicularly connected to one end of the second radiating section away from the first radiating section and extends toward the first side surface; the fourth radiating section is perpendicularly connected to one end of the third radiating section away from the second radiating section and extends toward the first radiating section.

16. The wireless communication device of claim 15, wherein the third radiating unit further comprises an extending section, the extending section is perpendicularly connected to one side of the first radiating section away from the grounding unit and extends away from the second radiating section.

17. The wireless communication device of claim 16, wherein the fourth radiating unit comprises a first connecting section; the first connecting section is electrically connected to an junction among the first radiating section, the second radiating section, and the extending section, extends toward the second side surface along a direction parallel to the third radiating section, and extends toward the third radiating section along a direction parallel to the second radiating section.

18. The wireless communication device of claim 17, wherein the fourth radiating unit further comprises a second connecting section; the second connecting section is perpendicularly connected to one end of the first connecting section away from the first radiating section, extends away from second radiating section along a direction parallel to the third radiating section, and extends toward the third radiating sheet along a direction parallel to the second radiating section.

19. The wireless communication device of claim 11, wherein one end of the second radiating unit is positioned on the bottom surface and resists the grounding unit; and the other end of the second radiating unit is positioned on the first side surface and extends toward a junction between the top surface and the first side surface.

20. The wireless communication device of claim 11, further comprising a metallic portion, wherein the metallic portion is positioned surround the baseboard; the fifth radiating unit comprises a latching member, a connecting member, and a coupling member, the latching member is electrically connected to the feed unit; one end of the connecting member is electrically connected to the latching member, the other end of the connecting member is electrically connected to the coupling member; and the coupling member is one portion of the metallic portion.

* * * * *